United States Patent [19]

Noguchi et al.

[11] 4,317,432

[45] Mar. 2, 1982

[54] TWO-CYCLE INTERNAL COMBUSTION ENGINE

[75] Inventors: Masaaki Noguchi, Nagoya; Yukiyasu Tanaka, Okazaki; Taro Tanaka, Chiryu, all of Japan

[73] Assignee: Nippon Soken, Inc., Nishio, Japan

[21] Appl. No.: 186,598

[22] Filed: Sep. 12, 1980

Related U.S. Application Data

[63] Continuation of Ser. No. 947,159, Sep. 28, 1978, abandoned.

[30] Foreign Application Priority Data

Oct. 10, 1977 [JP] Japan ..... 52-121328

[51] Int. Cl.[3] ..... F02B 15/00; F02B 17/00

[52] U.S. Cl. ..... 123/1 R; 123/257; 123/430; 123/432; 123/433; 123/65 R; 123/65 A; 123/69 R; 123/73 A; 123/143 R; 123/143 B; 123/DIG. 4

[58] Field of Search ..... 123/1, 257, 430, 432, 123/433, 431, DIG. 4, 69 R, 65 R, 65 A, 73 A, 143 R, 143 B

[56] References Cited

U.S. PATENT DOCUMENTS

| | | | |
|---|---|---|---|
| 3,363,611 | 1/1968 | Von Seggern et al. | 123/433 X |
| 3,923,019 | 12/1975 | Yamada | 123/430 |
| 3,934,562 | 1/1976 | Isaka | 123/DIG. 4 |
| 4,126,106 | 11/1978 | Witzky | 123/DIG. 4 |

FOREIGN PATENT DOCUMENTS

| | | | |
|---|---|---|---|
| 869305 | 4/1971 | Canada | 123/DIG. 4 |
| 5756794 | 6/1978 | Fed. Rep. of Germany | 123/DIG. 4 |

OTHER PUBLICATIONS

S.A.E. Tech. Paper Series 790840, Sep. 10–13, 1979, Society of Automotive Engineers, Warrendale, Penna., 16 pages.

*Primary Examiner*—Wendell E. Burns

*Attorney, Agent, or Firm*—Cushman, Darby & Cushman

[57] ABSTRACT

A method for operating a two-cycle internal combustion engine wherein in the scavenging stroke the air-fuel mixture charged into the cylinder forms a stratum adjacent to a piston and the stratum of the air-fuel mixture is made into contact with the stratum of the residual gases remote from the piston. Alternately, in the scavenging stroke the rich mixture is first charged into the cylinder immediately above the piston and then the lean mixture is charged into the cylinder immediately above the piston so that the strata of the lean and rich mixtures and the residual gases may be formed in the order named from a portion close to the piston within the cylinder. The decomposition of part of the air-fuel mixture or the rich air-fuel mixture is caused by the heat contained in the residual gases so that the chemically activated radicals are produced. In the compression stroke the air-fuel mixture or the rich air-fuel mixture containing these radicals is compressed to the compression ratio of between 4 and 10 and ignited and burned by the radicals mentioned above. The engine may operate with a low compression ratio. The engine may be made light in weight as compared with the diesel engines. The compression combustion is effected. The positive ignition may be ensured and the irregular and uncomfortable noise and vibration may be minimized. In addition, a considerable fuel economy may be attained and the emission of HC may be minimized. The two-cycle internal combustion engines adapted for carrying out the above method are also disclosed.

7 Claims, 13 Drawing Figures

TWO-CYCLE INTERNAL COMBUSTION ENGINE

This is a continuation, of application Ser. No. 947,159 filed Sept. 28, 1978 now abandoned.

BACKGROUND OF THE INVENTION

The present invention relates to an improvement of a method for operating a general-purpose two-cycle internal combustion engine to be operated under predetermined conditions and a two-cycle internal combustion engine itself best adapted for carrying out the above method.

Two-cycle diesel engines and two-cycle spark ignition engines have been long used as general purpose power sources under constant or predetermined conditions for generating an electric power, pumping water, driving a fan and so on. The diesel engines are most advantageous in the fuel economy, but the compression ratio is higher and because of their heavy weight it is difficult to relocate them from one place to another. Furthermore the combustion noise and vibration are so high that they are not suitable for use in the urban areas and especially in the residential areas. In addition, the diesel engines need a fuel supply system including a fuel injection pump, fuel injection valves which are operated under high pressures. Thus in terms of maintenance and cost the diesel engines are disadvantageous.

Spark ignition engines are lighter in weight and operate at a relatively low compression ratio. However it is difficult to concentrate a fresh charge around the spark plug. Furthermore the combustion is not stable because of misfire, and sometimes the fresh air-fuel mixture is short circuited to flow out of the combustion chamber. As a result, the fuel economy cannot be attained and the emission of a large quantity of HC results.

SUMMARY OF THE INVENTION

Accordingly, one of the objects of the present invention is to provide a method for operating a two-cycle internal combustion engine so that the ignitability may be improved, resulting in the fuel economy; noise and vibration may be minimized and the emission of HC may be also minimized.

Another object of the present invention is to provide a two-cycle internal combustion engines which are light in weight and which are especially adapted for carrying out the above method.

To the above and other ends, the present invention provides a method for operating a two-cycle internal combustion engine of the type in which the air-fuel mixture is charged into a cylinder in the scavenging stroke and is compressed in the compression stroke, said method comprising the steps of thermally chemically activating part of the air-fuel mixture charged into the cylinder so as to produce radicals, decomposing the air-fuel mixture by the heat of the residual gases and the heat generated by the adiabatic compression in the compression stroke, and compressing the air-fuel mixture containing said radicals to the compression ratio between 4 and 10 in the compression stroke, thereby igniting and burning said air-fuel mixture.

The present invention further provides a two-cycle internal combustion engine comprising a cylinder which defines a combustion chamber therein, a piston slidably fitted into said cylinder for reciprocal movement and a plurality of scavenging ports formed through the walls of said cylinder and covered and uncovered by the movement of said piston, said engine further comprising means for compressing the air-fuel mixture and charging the compressed air-fuel mixture into said cylinder through said scavenging ports, said means including means for interrupting the flow of said compressed air-fuel mixture to said cylinder in synchronism with the movement of said piston; and means for exhausting the residual gases from said cylinder, whereby said air-fuel mixture is charged in the form of a stratum only into a zone in the vicinity of said piston in said combustion chamber at the delivery ratio of between 0.15 and 0.35 and said stratum of said charged air-fuel mixture makes a contact with a stratum of residual gases and is ignited and burned in the compression stroke by the radicals produced around the boundary between the residual gases and air-fuel mixture.

According to one aspect of the present invention the two-cycle internal combustion engines are operated at a low compression ratio of between 4 and 10 and light in weight as compared with the diesel engines. Because of the compression combustion, the positive ignition is ensured in each cycle and noise and vibration is minimized. Furthermore a considerable fuel economy may be achieved and the emission of HC may also be minimized.

According to another aspect of the present invention both rich and lean mixtures may be used and even when the total air-fuel ratio of the whole rich and lean mixtures is low, the positive ignition may be ensured so that a great fuel economy may be achieved.

The present invention will become more apparent from the following description of some preferred embodiments thereof taken in conjunction with the accompanying drawings.

BRIEF DESCRIPTION OF THE DRAWINGS

Same reference numerals are used to designate similar parts throughout the figures.

Figure 1:
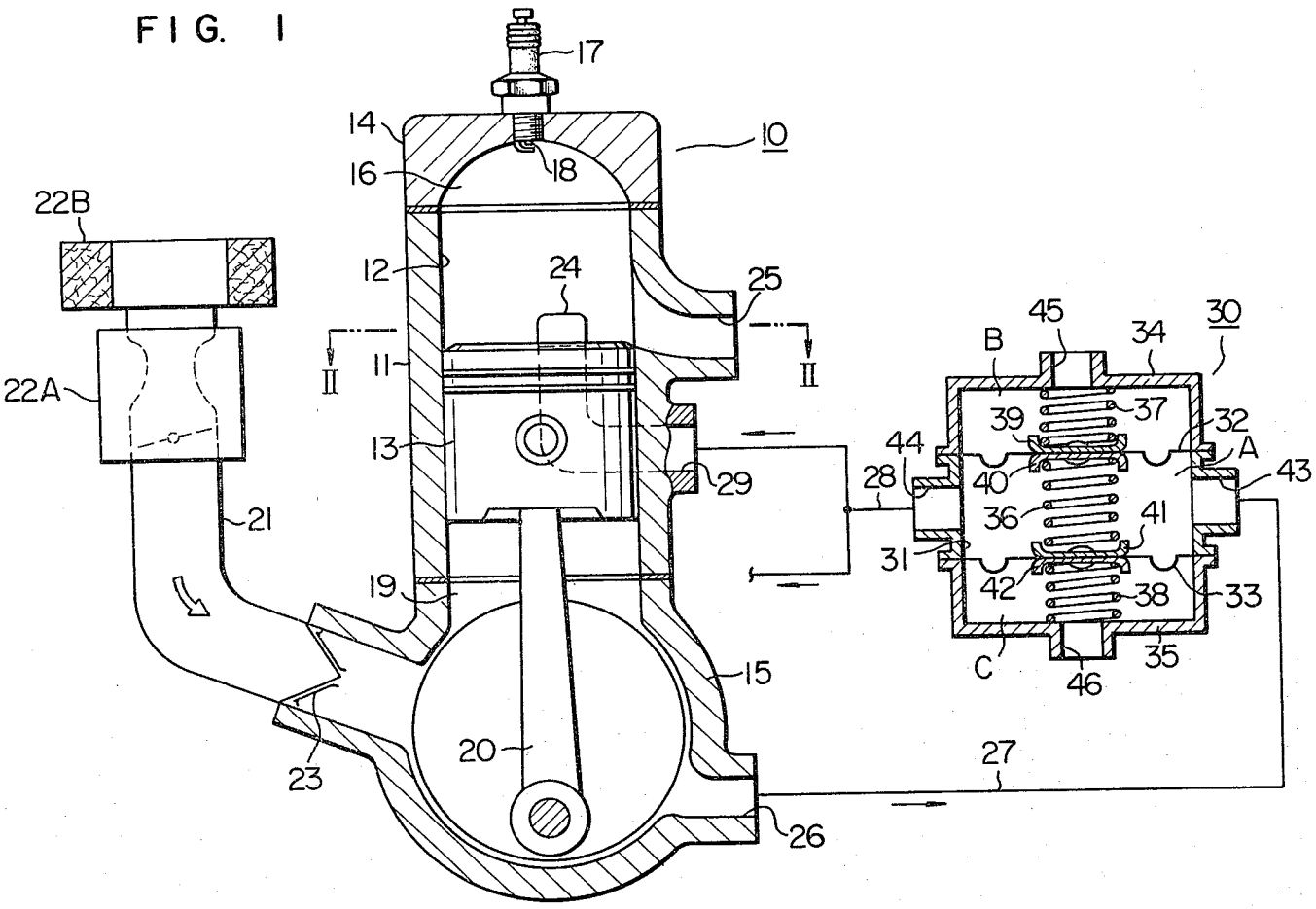
FIG. 1 is a schematic sectional view of an internal combustion engine especially adapted to carry out a first engine operating method of the present invention.
Figure 2:
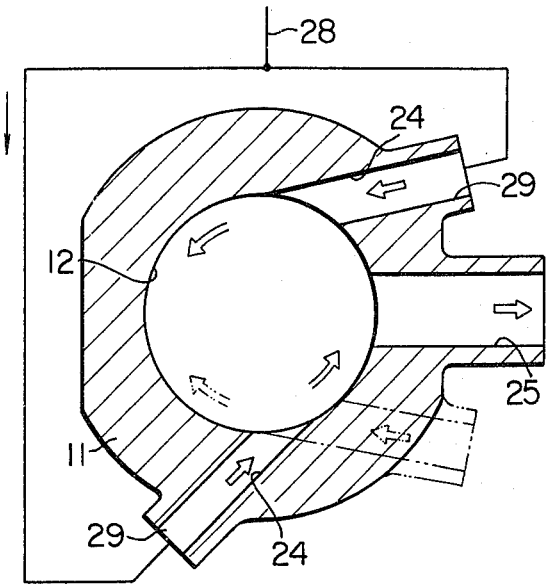
FIG. 2 is a horizontal sectional view, on enlarged scale, taken along the line II—II of FIG. 1.
Figure 3:
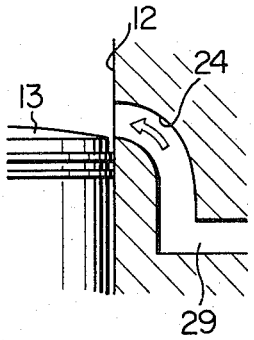
FIG. 3 is a fragmentary sectional view, on enlarged scale, showing a scavenging port.

DESCRIPTION OF THE PREFERRED EMBODIMENTS First Embodiment, FIGS. 1-3

Referring to FIGS. 1-3, a two-cycle internal combustion engine generally indicated by the reference numeral 10 is a reciprocating engine of Schnürle type with a single cylinder and with crankcase compression. The compression ratio is between 4 and 10. A cylinder block 11 has a cylinder 12 into which is reciprocably fitted a piston 13. A cylinder head 14 and a crankcase 15 are joined to the cylinder block 11.

The cylinder block 11, the piston 13 and the cylinder head 14 define a combustion chamber 16 and an ignition plug 17 is screwed into the cylinder block 11 so as to ignite the air-fuel mixture in the combustion chamber 16 by the spark produced between the center and ground electrodes 18 of the ignition plug 17.

A crankshaft which is connected through a connecting rod 20 to the piston 13 is disposed within a crank chamber 19 within the crankcase 15. An air cleaner 22B and a carburetor 22A are communicated through an intake pipe 21 with the crankcase 15. The air-fuel mixture from the carburetor 22A is charged into the crank chamber 19 through the intake pipe 21 and a reed valve 23 when the piston 13 moves upwards.

As shown by solid lines in FIG. 2, the cylinder 12 has two scavenging ports 24 which are in substantially symmetrical positions with respect to the axis of the cylinder 12 and are in an opposed relationship. However, one of these ports may be formed in the position shown by imaginary lines in FIG. 2. The cylinder 12 has also an exhaust port 25. Each scavenging port 24 is communicated through a pipe 27, a resonator 30, a pipe 28 and a scavenging passage 29 with an air-fuel mixture supply port 26 formed in the crankcase 15. When the piston 13 moves downwards, the air-fuel mixture in the crank chamber 19 is forced into the cylinder 12.

Each scavenging port 24 is horizontal and tangential to the cylinder 12, giving the entering air-fuel mixture a gentle swirling or vortex motion.

The resonator 30 controls the supply of the air-fuel mixture to the scavenging ports 24. It has an upper casing 34, an intermediate casing or housing 31 and a lower casing or cover 35 and a first or upper diaphragm 32 is interposed between the upper and intermediate casings 34 and 31 while a second or lower diaphragm 33 is interposed between the intermediate and lower casings 31 and 35, whereby three chambers A, B and C are defined within the resonator 30. A coiled compression spring 37 is loaded between the upper casing 34 and the first or upper diaphragm 32; a coiled compression spring 36 between the upper diaphragm 32 and the lower diaphragm 33; and a coiled compression spring 38 between the lower diaphragm 33 and the lower casing 35. Spring retainers 39, 40, 41 and 42 mounted on the diaphragms 32 and 33 serve not only to retain the coiled compression springs 36, 37 and 38 and transmit their forces to the diaphragms 32 and 33 but also to function as the resonant weights.

The intermediate chamber A is communicated through a port 43 with the pipe 27 and through a port 44 with the pipe 28. The upper and lower chambers B and C are communicated through ports 45 and 46, respectively, with the surrounding atmosphere.

Next the mode of operation of the first embodiment with the above construction will be described. The scavenging ports 24 and the exhaust port 25 are covered and uncovered as the piston 13 reciprocates in the cylinder 12. That is, when the piston 13 moves downwards in the scavenging stroke, the exhaust port 25 is uncovered first and then the scavenging ports 24 are uncovered so that the air-fuel mixture is charged from the crank chamber 19 through the pipe 27, the resonator 30, the pipe 28, the scavenging passage 29 and the scavenging ports 24 into the cylinder 12. The charged air-fuel mixture forms gentle scavenging streams in the cylinder 12.

Since the scavenging ports 24 are horizontal and tangential to the cylinder 12, and also since the amount of the air-fuel mixture charged into the cylinder 12 is restricted and small, the scavenging stream has no upward velocity component and consequently swirls at the top of the piston 13, inclusive of the case where one of the scavenging ports is formed in the position shown by the imaginary lines in FIG. 2. As a result the fresh air-fuel mixture enters the lower portion of the cylinder 12 immediately above the piston 13 so that the residual gases are forced to flow upwards in the cylinder 12. Thus the stratified admission is effected.

When the charging of the fresh air-fuel mixture is continued even after the piston 13 starts the upward movement from its bottom dead point, there is a possibility that the stratified air-fuel mixture in the cylinder 12 is disturbed. Therefore the resonator 30 is provided in order to interrupt the charging of the fresh air-fuel mixture after the piston 13 has started the upward movement as will be described in detail below.

When the piston moves downwards in the scavenging stroke, the air-fuel mixture flows from the crank chamber 19 into the intermediate chamber A in the resonator 30 so that the chamber A is expanded while the upper and lower chambers B and C are reduced in volume. The spring 36 in the intermediate chamber A is extended while the springs 37 and 38 in the upper and lower chambers B and C are compressed.

When the piston 13 further moves downwards to uncover the scavenging ports 24, the air-fuel mixture in the pipe 28 and the intermediate chamber A within the resonator 30 flows into the cylinder 12 so that the pressure in the intermediate chamber A suddenly drops. As a result the upper and lower chambers B and C expand so that the springs 37 and 38 in the upper and lower chambers B and C extend to compress the spring 36 in the intermediate chamber A and hence the chamber A. Thus the charging of the fresh air-fuel mixture into the cylinder 12 may be much facilitated.

After the springs 37 and 38 in the upper and lower chambers B and C have been extended and the diaphragms 32 and 33 have been returned to their equilibrium positions, the coil spring 36 in the intermediate chamber A is extended so that the intermediate chamber A is expanded. As a result the pressure in the intermediate chamber A and the scavenging passageway 29 drops suddenly, whereby the charging of the fresh air-fuel mixture may be interrupted.

When the fresh air-fuel mixture charging interruption or cut-off timing is made to coincide with the time when the piston 13 reaches its bottom dead center, the charging of the fresh air-fuel mixture may be positively cut off in the compression stroke or when the piston 13 moves upwards. Thus the fresh air-fuel mixture may be timely charged. The pressure variation at a certain frequency in the intermediate chamber A in the resonator 30 may be continued by the suitable choice of the scavenging pressure, the forces of the coil springs 36, 37 and 38 and the weights of the spring retainers 39, 40, 41 and 42 so that a desired air-fuel mixture charging timing may be obtained as described above. Thus the satisfactory stratified admission may be ensured without the disturbance of the residual or spent gases in the cylinder 12 and the combustion chamber 16.

At the boundary between the stratified fresh air fuel mixture and the residual gases, the decomposition of part of gasoline in the mixture occurs due to the heat of the residual gases and the heat generated by the adiabatic compression in the compression stroke so that chemically highly active radicals such as CH, $C_2$, OOH, CHO, H and so on are produced.

These radicals are highly combustible so that the charge containing them may be easily ignited and burned when compressed even without the use of the ignition plug 17. That is, these radicals serve as the igniter.

Figure 4:
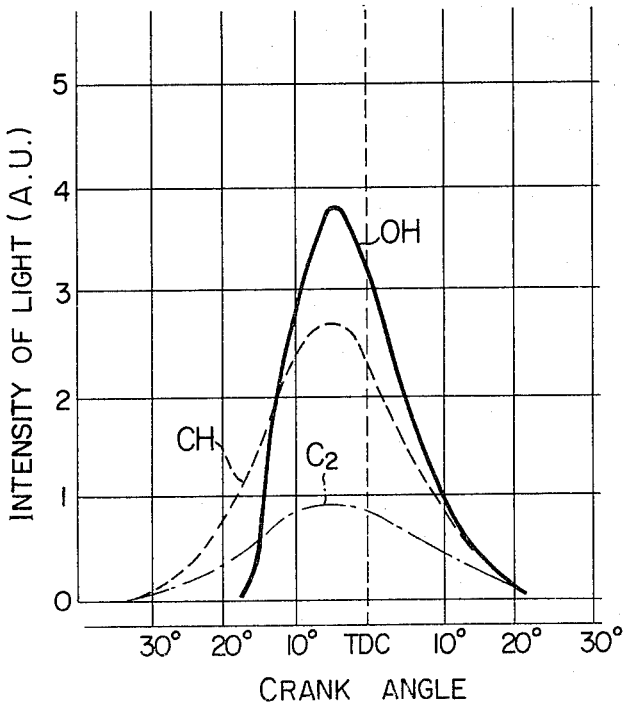
FIG. 4 is a graph illustrating the relationship between the quantity of radicals produced and the crank angle.
Figure 5:
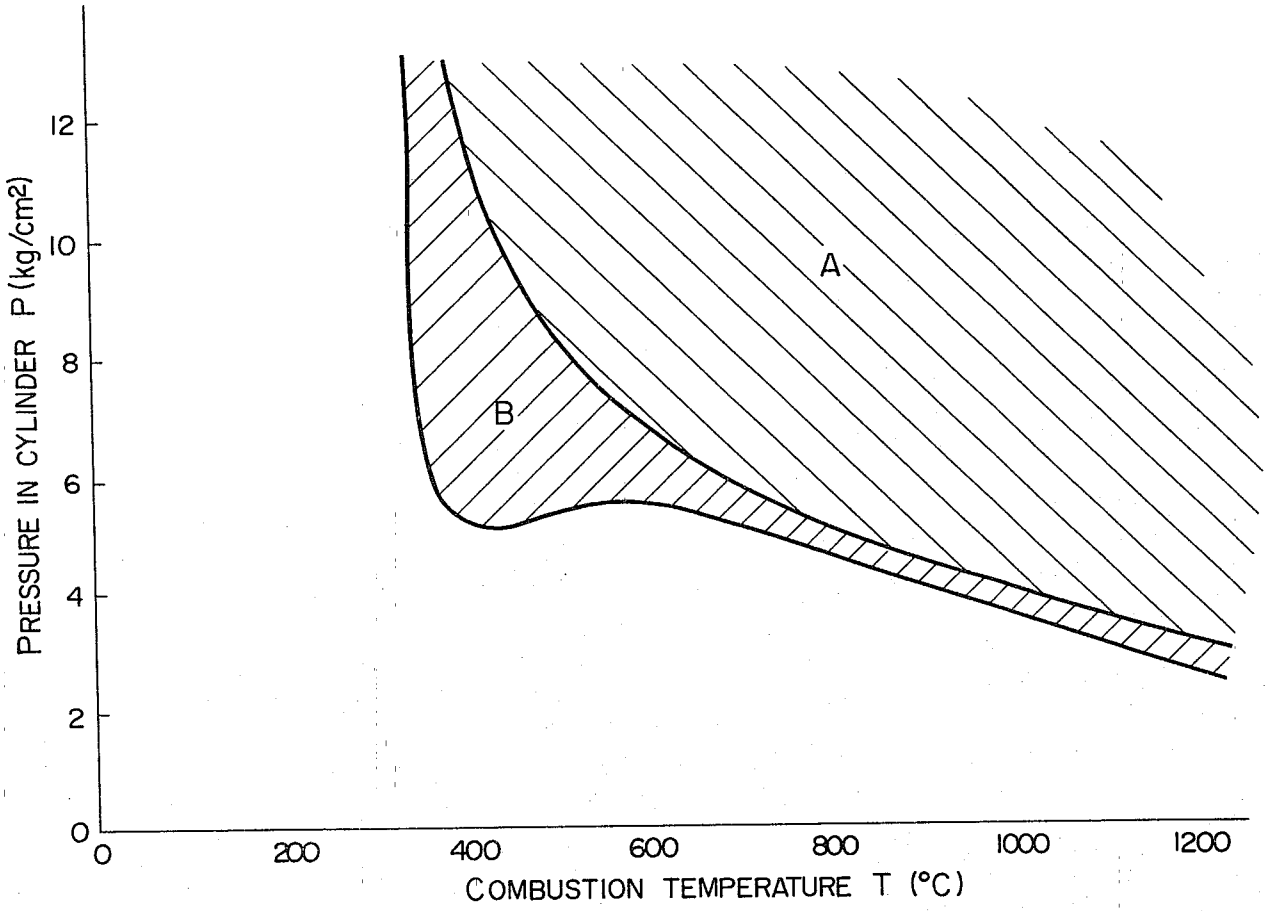
FIG. 5 shows the zone A at which the diesel engines are operable and the zone B at which the two-cycle internal combustion engines of the present invention are operable, these zones A and B being plotted in terms of the pressure in $kg/cm^2$ in the cylinder and the combustion temperature in °C.

These radicals were optically measured and their yields were plotted in terms of the intensity of light as shown in FIG. 4. It can be seen that CH and $C_2$ which are most combustible are produced from the crank angle about 30° before the top dead center. The production of OH radical is observed from the crank angle about 20° before the top dead center. As described above these radicals are highly combustible so that the air-fuel mixture may be easily ignited and burned even at such low compression ratio between 4 and 10 as shown in FIG. 5 in which the maximum pressure P is plotted along the ordinate while the combustion temperature T (°C) along the abscissa. The diesel engines are operable only in the region A of high temperatures and high pressures, but according to the present invention two-cycle engines are operable in the region B of low temperatures and low pressures. Since the radicals were prouuced which enhance the ignition and combustion of the air-fuel mixture, the positive ignition and combustion may be ensured in each cycle and the irregular and uncomfortable noise and vibrations may be minimized. Furthermore because of the improvement in ignitability, the emission of HC may be considerably reduced as compared with the conventional spark-ignition engines. Moreover leaner air-fuel mixture may be burned so that the fuel consumption may be considerably reduced.

The ignition plug 17 is used only in case of starting of the engine so that the amount of electric power used may be also reduced as compared with the conventional spark-ignition engines.

So far the first embodiment has been described in conjunction with the stratification of the fresh air-fuel mixture and the burned gases, but it is more preferable to stratify the burned gases, the rich air-fuel mixture and the lean air-fuel mixture so as to facilitate the production of the radicals as will be described in detail hereinafter.

Figure 6:
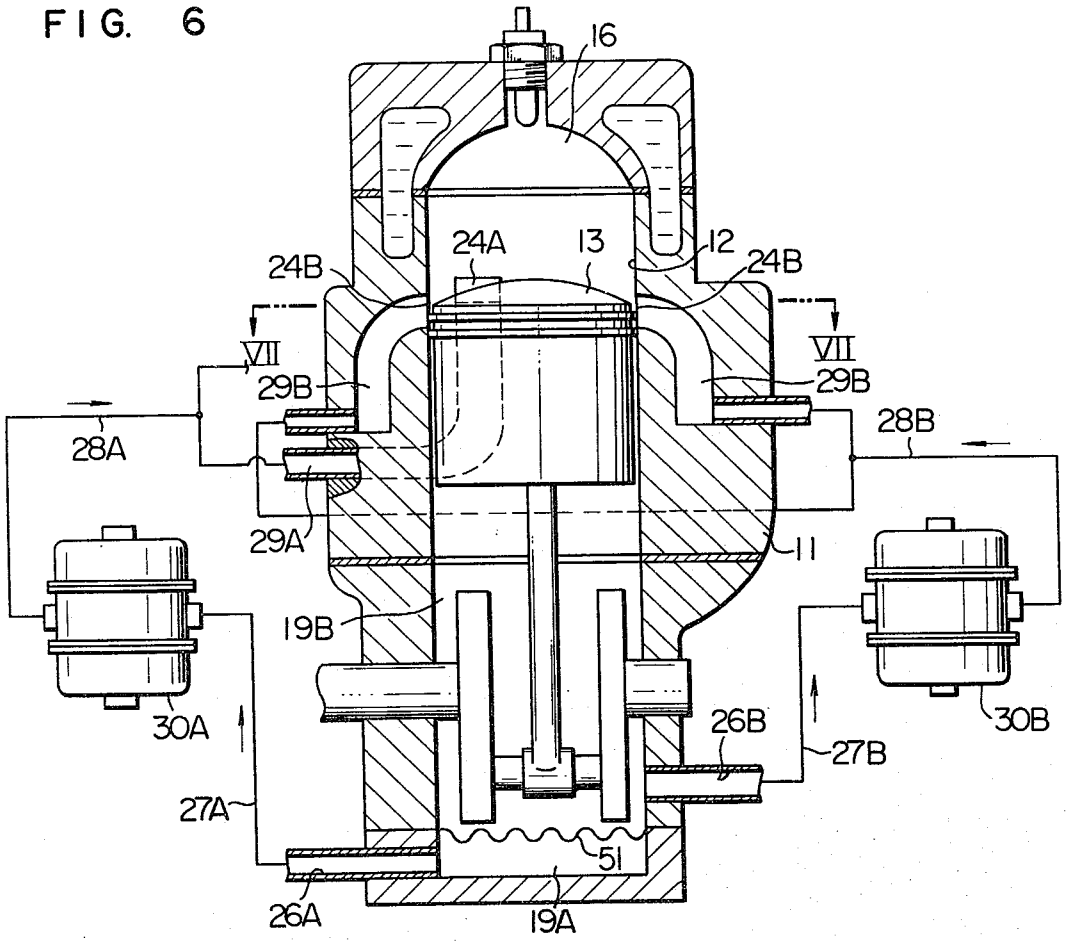
FIG. 6 is a schematic sectional view of an internal combustion engine especially adapted for carrying out a second engine operating method of the present invention.
Figure 7:
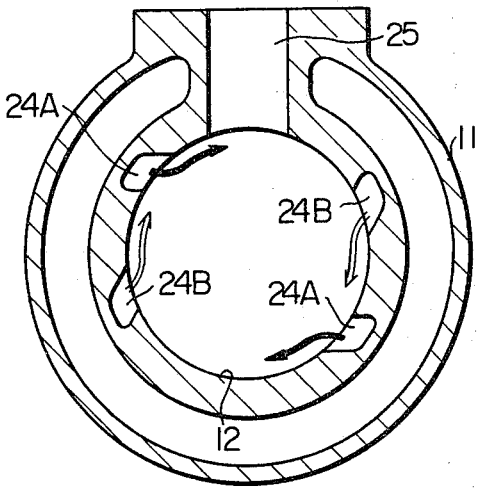
FIG. 7 is a cross sectional view, on enlarged scale, thereof taken along the line VII—VII of FIG. 6.

Second Embodiment, FIGS. 6 and 7

Referring to FIGS. 6 and 7, the crank chamber consists of a first crank chamber 19A and a second crank chamber 19B which are separated from each other with a separating membrane 51 which is very elastic. As is the case with the first embodiment, a rich air-fuel mixture flows into the first crank chamber 19A through an intake pipe and a reed valve (not shown) from a carburetor (not shown) when the piston 13 is driven upwards. The rich mixture refers to an air-fuel mixture whose ratio is higher than the theoretical mixture ratio. In like manner, a lean mixture whose ratio is lower than the theoretical mixture ratio is forced to enter the second crank chamber 19B when the piston 13 is driven upwards.

The cylinder 12 has a pair of rich-mixture scavenging ports 24A and a pair of lean-mixture scavenging ports 24B. Each pair of the scavenging ports 24A and 24B are at substantially symmetrical portions with respect to the axis of the cylinder 12 and are in an opposed relationship. Furthermore, the cylinder 12 has one exhaust port 25 which is uncovered first in the scavenging stroke. Next the first scavenging ports or rich mixture scavenging ports 24A are uncovered and then the second scavenging ports or the lean-mixture scavenging ports 24B are uncovered. The first scavenging ports 24A are communicated with a rich mixture discharge port 26A of the first crank chamber 19A through a pipe 27A, a rich-mixture resonator 30A, a pipe 28A and a rich-mixture scavenging passageway 29A. In like manner, the second scavenging ports 24B are communicated with a lean-mixture discharge port 26B of the second crank chamber 19B through a pipe 27B, a lean-mixture resonator 30B, a pipe 28B and a lean-mixture scavenging passageway 29B. Thus when the piston 13 is driven downwards or in the scavenging stroke, the rich and lean-mixtures enter into the cylinder 12 through the first and second scavenging ports 24A and 24B, respectively.

The first and second scavenging ports 24A and 24B are horizontal and tangential to the cylinder 12 as in the case of the first embodiment so that the entering mixtures swirl gently. The rich- and lean-mixture resonators 30A and 30B are substantially similar in construction and mode of operation to the resonator 30 described above so that no further description thereof shall be made in this specification.

The first and second scavenging ports 24A and 24B and the exhaust port 25 are uncovered and covered as the piston 13 is reciprocated. When the piston 13 is driven downwards, the exhaust port 25 is opened first and the first and second scavenging ports 24A and 24B are uncovered in that order. The rich mixture is slowly introduced into the cylinder 12 through the first scavenging ports 24A and forms gentle vortexes directly above the top of the piston 13 because the rich mixture has no upward component of velocity. The residual gases are directed to the upper portion of the cylinder 12. Thus the strata of the residual gases and the rich mixture are formed in the upper portion in the cylinder 12.

When the piston 13 is further driven downwards to uncover the second scavenging ports 24B, the lean-mixture flows along the top of the piston 13 so that the strata of the rich and lean-mixtures may be formed in the lower portion of the cylinder 12. When the piston 13 is driven upwards, the chargings of the rich and lean mixtures are interrupted by the rich- and lean-mixture resonators 30A and 30B in a manner substantially similar to that of the resonator 30 of the first embodiment. That is, the chargings of the rich and lean mixtures are precisely timed so that gases may be distinctly stratified in the cylinder 12.

In the compression stroke the decomposition of part of gasoline in the rich mixture occurs, as in the first embodiment, at the boundary between the residual gases and the rich mixture due to the heat contained in the residual gases and the heat liberated by the adiabatic compression so that chemically highly active radicals such as CH, $C_2$, OOH, CHO, H and so on are produced.

Because of rich mixture is excessively heated, these radicals are produced in large quantity so that even when the fuel-air ratio of the whole of the rich and lean mixtures is considerably lower than the fuel-air ratio of the air-fuel mixture used in the first embodiment, the positive ignition and combustion may be ensured and consequently a great fuel economy may be achieved.

Figure 8:
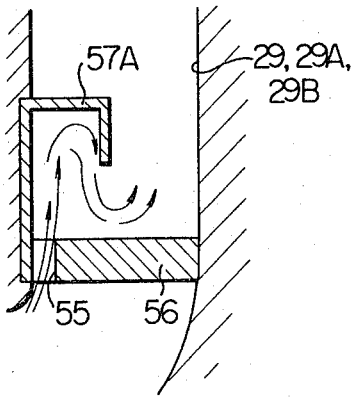
FIGS. 8, 9 and 10 show the arrangements of a deflector disposed in a scavenging passageway.
Figure 9:
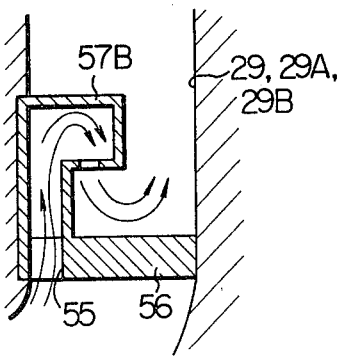
Figure 10:
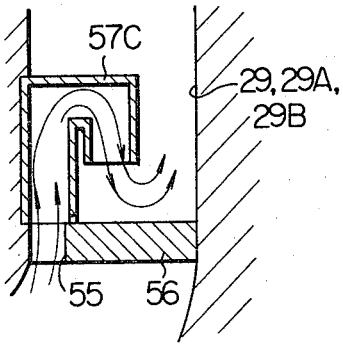

Deflectors, FIGS. 8–10

In the first and second embodiments, the air-fuel mixtures are charged into the cylinder 12 in such a way that they swirl. More satisfactory stratified admission may be effected by use of the combination of a partition wall 56 with an orifice 55 formed therein and a deflector 57A, 57B or 57C as shown in FIGS. 8–10. The partition wall 56 and the deflector 57A, 57B or 57C, which reverses the flow of the air-fuel mixture, are provided in the scavenging passageways 29, 29A or 29B, respectively, and the deflector is positioned at the upstream of the orifice 55. The partition wall 56 with the orifice 55 and the deflector 57A, 57B and 57C cause a more gentle flow of air-fuel mixture toward the scavenging ports 24 or 24A and 24B so that the mixture of the fresh charge with the residual gases may be prevented.

The deflector 57A shown in FIG. 8 is made of a plate which is in the form of a letter L in cross section. The deflector 57B shown in FIG. 9 is so formed as to define an inverted L-shaped space. The deflector 57C shown in FIG. 10 is made of a pipe bent in the form of an inverted L.

Figure 11:
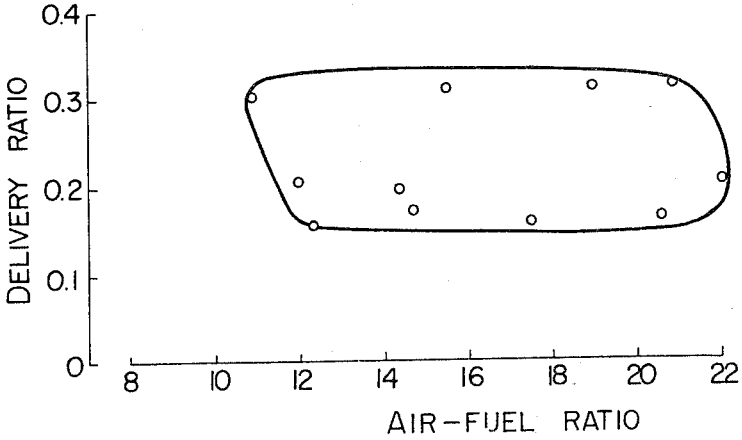
FIG. 11 shows the relationship between the delivery ratio and the air-fuel ratio of the two-cycle internal combustion engine when operated in accordance with the present invention.

FIG. 11 shows the relationship between the delivery ratio and the air-fuel ratio in the two-cycle internal combustion engines of the first and second embodiments. It can be seen that the compression ignition is possible with the delivery ratio between 0.15 and 0.35. In this specification and the following claims the term "delivery ratio" refers to the ratio of the volume of the air-fuel mixture which has been charged into the cylinder to the volume of the combustion chamber when the piston reaches its bottom dead center in the scavenging stroke. When the delivery ratio is in excess of 0.35, the temperature in the combustion chamber is too low to cause the compression ignition. On the other hand when the delivery ratio is less than 0.15, the fuel is too less in quantity so that the compression ignition is impossible or the output of the engine is too low.

Figure 12:
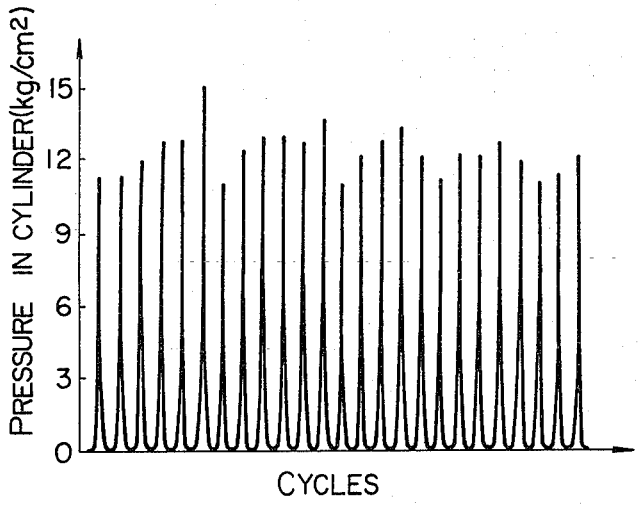
FIG. 12 is an indicator diagram of a conventional two-cycle internal combustion engine.
Figure 13:
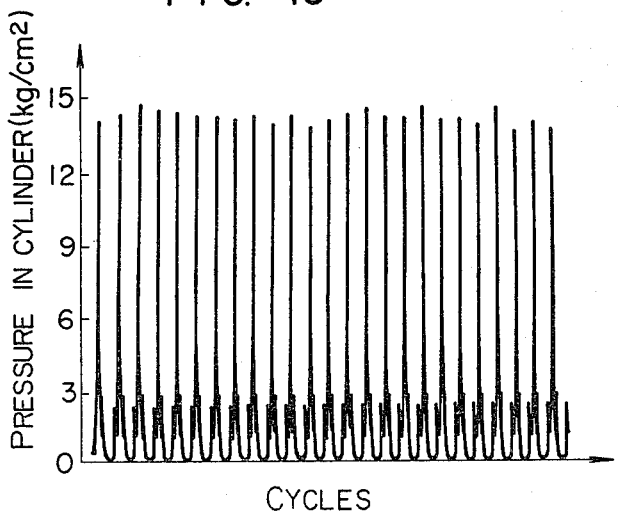
FIG. 13 is an indicator diagram of a two-cycle internal combustion engine in accordance with the present invention.

FIG. 12 is an indicator diagram of a conventional Shnürle type two-cycle engine (223 cc). It can be seen that the pressure in the combustion chamber varies over a wide range. The low pressure peak shows a misfire causing unsatisfactory exhaust. FIG. 13 is an indicator diagram of a two-cycle compression ignition engine (223 cc) of the present invention. It can be clearly seen that the peak pressures are equalized to a certain level, i.e., the deviation from the mean value is small, which means the stable combustion.

So far the present invention has been described in detail in connection with the Shnürle type two-cycle engine, but it will be understood that the present invention may be equally applied to the Junkers engines, the Mann engines, the uniflow two-cycle engines and so on and that, in addition to gasoline, kerosine, alcohols, LPG and LNG may be used.

What we claim is:

1. A method for operating a two-cycle internal combustion engine with a single or sole combustion chamber of the type in which the air-fuel mixture is charged into a cylinder in the scavenging stroke and compressed in the compression stroke, said method comprising charging, during the downward movement of the piston, the rich air-fuel mixture in the state of a gentle stream into the cylinder immediately above a piston in the scavenging stroke; thereafter charging the lean air-fuel mixture in the state of a gentle stream into the cylinder immediately above the piston, thereby forming strata of the residual gases, the rich air-fuel mixture and the lean air-fuel mixture in the cylinder from a portion remote from the piston in the order named and in contact with each other; while preventing further fuel charging during upward movement of the piston chemically activating part of the rich air-fuel mixture by the heat contained in the residual gases, thereby producing radicals; and compressing the rich air-fuel mixture containing said radicals and the lean air-fuel mixture to the compression ratio between about 4 and 10 in the compression stroke, thereby effecting compression ignition and burning of the rich and lean air-fuel mixtures.

2. A method for operating a two-cycle internal combustion engine as set forth in claim 1 wherein in the scavenging stroke the rich and lean air-fuel mixtures are charged into the cylinder at the delivery ratio between about 0.15 and 0.35.

3. A method for operating a two-cycle internal combustion engine as set forth in claim 1 wherein said radicals include at least one of $C_2$, CH, CHO, OOH and H.

4. A method for operating a two-cycle internal combustion engine as set forth in claim 1, 2 or 3 wherein the rich and lean mixtures are charged into the cylinder substantially in parallel with the top of the piston in the scavenging stroke.

5. A method for operating a two-cycle internal combustion engine as set forth in claim 1, 2 or 3 wherein the rich and lean air-fuel mixtures are charged into the cylinder so as to form a swirl above said piston in the scavenging stroke.

6. A method for operating a two-cycle internal combustion engine as set forth in claim 1, 2 or 3 wherein the charging of the rich and lean air-fuel mixtures into the cylinder is interrupted when the compression stroke is started.

7. A method for operating a two-cycle internal combustion engine as set forth in claim 1, 2 or 3 wherein in the scavenging stroke the rich and lean mixtures which have been decelerated by means of deflectors are charged into the cylinder.

* * * * *